US009826809B2

(12) United States Patent
Carter

(10) Patent No.: US 9,826,809 B2
(45) Date of Patent: Nov. 28, 2017

(54) COMBINATION ACCESSORY BAG AND DIAPER CHANGING STATION

(71) Applicant: Justin Carter, Van Nuys, CA (US)

(72) Inventor: Justin Carter, Van Nuys, CA (US)

( * ) Notice: Subject to any disclaimer, the term of this patent is extended or adjusted under 35 U.S.C. 154(b) by 229 days.

(21) Appl. No.: 14/645,035

(22) Filed: Mar. 11, 2015

(65) Prior Publication Data

US 2015/0257500 A1 Sep. 17, 2015

Related U.S. Application Data

(60) Provisional application No. 61/951,787, filed on Mar. 12, 2014.

(51) Int. Cl.
*A45C 9/00* (2006.01)
*A47D 5/00* (2006.01)

(52) U.S. Cl.
CPC ..... *A45C 9/00* (2013.01); *A47D 5/006* (2013.01)

(58) Field of Classification Search
CPC .. A45C 11/00; A45C 9/00; F41B 5/14; A47D 5/006
See application file for complete search history.

(56) References Cited

U.S. PATENT DOCUMENTS 1,198,773 A 9/1916 Robinson
1,458,952 A * 6/1923 Prokesch ..... A45C 3/06 150/101
2,247,320 A * 6/1941 Stanley ..... A45C 11/008 150/114
2,253,024 A 8/1941 Farrand
2,259,267 A 10/1941 Ranken
2,531,501 A * 11/1950 Cline ..... A45C 3/10 135/116
2,584,432 A * 2/1952 De Marco ..... A45F 4/04 135/148
2,656,844 A 10/1953 Kreuzer
3,601,825 A * 8/1971 Moorhead ..... A47C 29/003 135/117
D232,850 S 9/1974 Bloyd
3,847,170 A * 11/1974 Anderson ..... E04H 15/30 135/116
3,848,279 A * 11/1974 Ipsen, Jr. ..... A47C 17/70 135/117
4,239,135 A 12/1980 Armstrong
4,693,512 A * 9/1987 Hobson ..... A63G 9/00 297/184.17
5,458,146 A 10/1995 Gregg
5,926,881 A 7/1999 Madison
6,390,260 B1 * 5/2002 Roegner ..... A45C 3/00 190/1

(Continued)

*Primary Examiner* — Tri Mai
(74) *Attorney, Agent, or Firm* — Kelly & Kelley, LLP

(57) ABSTRACT

At least one flexible sheet of material forms a casing configured to be folded into an accessory bag and unfolded into a diaper changing station. A frame assembly is at least partially disposed within the casing. A canopy is attached to the casing and an arm of the frame assembly, the arm and canopy being selectively movable between a collapsed position adjacent the base and an extended position away from the base to form an open-ended tent structure at a first end of the base. A padded diaper changing pad is disposed under the canopy. One or more pockets are formed in or attached to the base or the canopy.

1 Claim, 7 Drawing Sheets

(56) References Cited

U.S. PATENT DOCUMENTS

| | | | | |
|---|---|---|---|---|
| 6,516,745 | B1 | 2/2003 | Spires et al. | |
| 6,581,228 | B1 * | 6/2003 | Boskovich | A47D 5/006 108/115 |
| 7,127,753 | B1 | 10/2006 | Ramaley | |
| 7,438,078 | B2 | 10/2008 | Woodruff et al. | |
| 7,587,774 | B2 | 9/2009 | Mayes et al. | |
| 2003/0066550 | A1 | 4/2003 | Al-Ghamdi | |
| 2009/0114691 | A1 * | 5/2009 | Bizzell | A47D 13/02 224/577 |
| 2011/0297201 | A1 * | 12/2011 | Chen | E04H 15/42 135/144 |
| 2012/0098302 | A1 | 4/2012 | Place | |

* cited by examiner

COMBINATION ACCESSORY BAG AND DIAPER CHANGING STATION

RELATED APPLICATION

This application claims the benefit of U.S. Provisional Application No. 61/951,787, filed on Mar. 12, 2014.

BACKGROUND OF THE INVENTION

The present application generally relates to a diaper changing pad or station. More particularly, the present invention relates to a portable, collapsible infant changing pad having a pop-up canopy that also serves as an accessory bag.

Babies and infants in diapers must periodically have their diapers changed. At home, this is not an issue as the parent or caretaker can usually change the baby's diaper on a dedicated changing table. Otherwise, the infant's diaper can be changed on a bed, a carpeted floor, or the like. These situations provide a safe environment for the infant's diaper to be changed, and is relatively private as either only the parent or caretaker is changing the diaper, with perhaps immediate family members in the area.

However, when traveling outside of the house the infant's diaper must be changed in public. The parent must place the infant on a bathroom counter, a hinged changing table sometimes found in bathrooms, a bench, or even the ground. The hinged infant changing tables in bathrooms are notoriously unstable. Laying the infant on the elevated surface is dangerous since the child can easily roll or slip and fall, resulting in serious injury.

There are instances where a bathroom or bench is not readily available, such as when at a park, camping or hiking. In such cases, when changing the diaper the infant is often placed on the grass or ground. This is both unsanitary and uncomfortable for the infant.

Furthermore, a parent often wishes to conceal the infant from public view when the infant's diaper is changed. Those passing by may not want to view a soiled diaper as it is being changed, and the parent or caretaker may be very self-conscious of this. The parent or caretaker may want to have privacy for the infant as well.

Portable diaper changing pads are well known. Such changing pads are typically of a size so as to at least partially place the infant thereon and have an upper surface material which can easily be cleaned in the event it becomes soiled while changing the infant.

However, these changing pads, while portable, have various drawbacks. The changing pad may have insufficient padding so as to keep the baby or infant comfortable on the ground or other hard surface while the infant's diaper is changed. Moreover, many of these changing pads are of a size so as to only fit under a portion of the infant, the infant's feet and/or upper torso and head at times extending to the underlying supporting surface, which may be a hard counter, the grass, or even dirt. Furthermore, such conventional changing pads do not include any means for providing privacy to the infant and parent while the diaper is changed, or otherwise protect the infant from the sun, wind, etc.

In the case of portable diaper changing pads, the parent or caretaker of the infant must also have a supply of diapers, wipes, ointment and the like. This requires that the parent or caretaker have a bag, in addition to the diaper changing pad, for carrying such diaper changing accessory items. However, such diaper bags are typically large and bulky as they are often sized and configured to carry many other items, such as a baby's blanket, toys, bottles, etc.

Accordingly, there is a continuing need for a diaper changing pad which provides a clean, comfortable place to place the infant on so that the infant can sleep or have his or her diaper changed. There is also a continuing need to have such a diaper changing pad which provides privacy and conceals the baby from public view when changing the baby's diaper, and protects the baby from harmful UV rays or the wind while the infant's diaper is being changed. There is also a continuing need to provide such an infant diaper changing pad which is both collapsible so as to be readily stored and transported. There is also a continuing need to provide such an infant diaper changing pad which is collapsible into an accessory bag which can easily be carried and transported and which is configured to hold the accessories necessary for changing a baby's diaper. The present invention fulfills these needs, and provides other related advantages.

SUMMARY OF THE INVENTION

The present invention resides in an accessory bag which can be unfolded to create a diaper changing station having a pop-up canopy. The invention generally comprises a casing comprising at least one flexible sheet of material configured to be folded into an accessory bag and unfolded into a diaper changing station base. A canopy is attached to the casing and an arm of the frame assembly. The canopy and the arm are selectively movable between a collapsed position adjacent to the base and an extended position away from the base to form an open-ended tent structure at a first end of the base.

The frame assembly comprises a hinge between the arm and a first base frame. A locking mechanism locks the arm in a collapsed or extended position. The locking mechanism may comprise a push-button locking mechanism and hinge assembly. The first base frame comprises generally parallel rods attached to or disposed within the base. A cross-member may extend between the parallel rods. The frame assembly may include a second base frame, separate from the first base frame, attached to or disposed within the base. The second base frame comprises generally parallel rods and may include a cross-member extending between the rods.

The canopy comprises first and second side walls and a rear wall, each having an edge thereof attached to the base. A window may be formed in at least one of the canopy first wall, second wall or rear wall. The window may be comprised of a mesh material.

A padded diaper changing pad is disposed under the canopy. The changing pad may be removable from the open-ended tent structure.

A pocket is formed in, or attached to, the base or canopy. The pocket may be formed in or attached to an inner surface of a flap portion of a second end of the base. The pocket may include a closure for selectively closing and opening the pocket.

Fasteners may be attached to the flap portion of the base and a corresponding portion of the casing for selectively fastening the flap portion to the casing when the casing is folded into the accessory bag. A carry strap may be attached to the casing, so as to enable the user to easily carry and transport the folded accessory bag.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention relates to an apparatus, generally referred to by the reference number 10, which is a combination accessory bag and diaper changing station. As will be more fully explained herein, the apparatus, when in the folded accessory bag configuration is capable of being easily transported and stored. However, when unfolded into the diaper changing station, a pop-up canopy provides privacy as well as protection from outdoor elements, such as the sun and wind, to the infant having his or her diaper changed.

Figure 1:
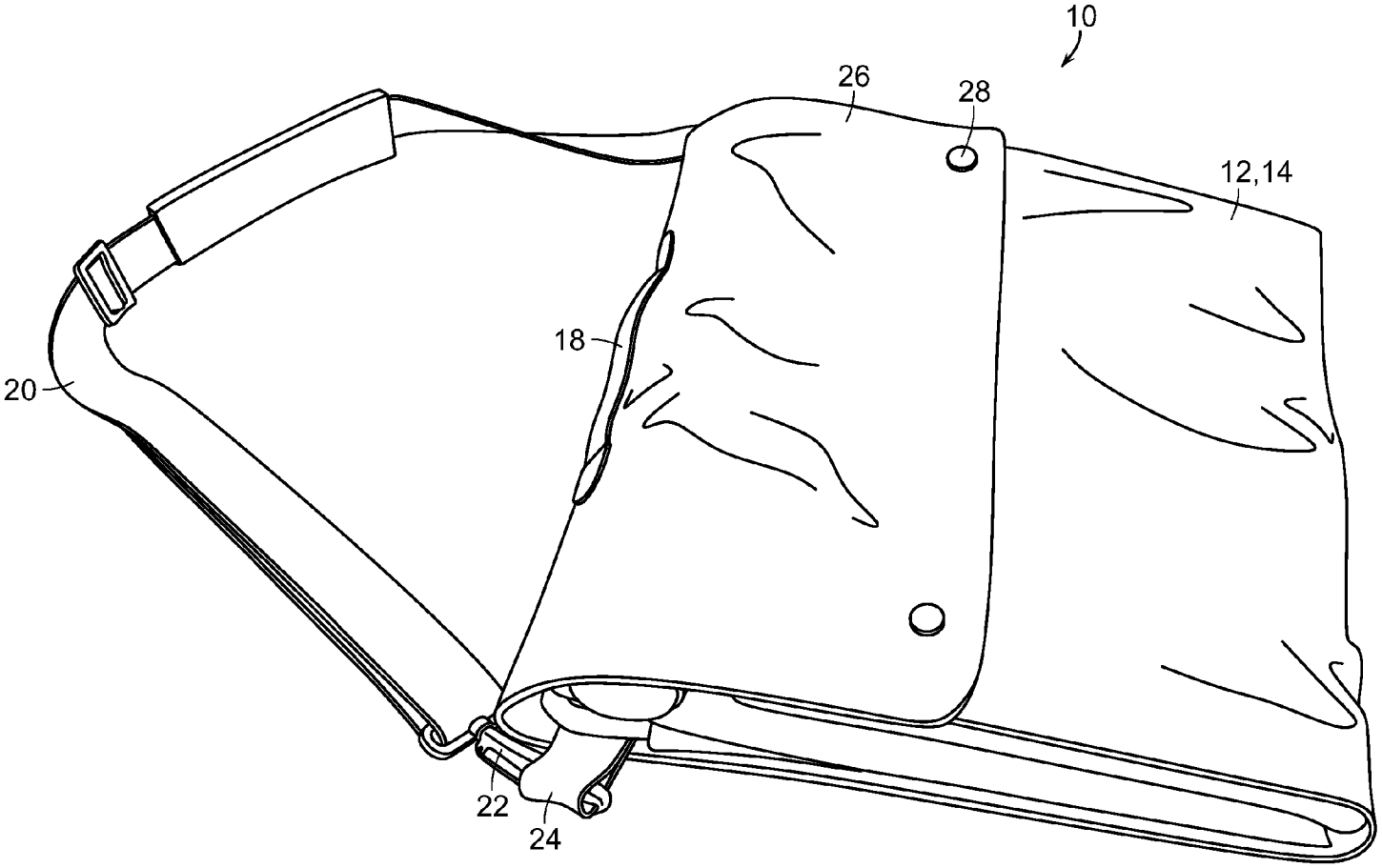
FIG. 1 is a top perspective view of a combination accessory bag and diaper changing station apparatus embodying the present invention, in a folded accessory bag configuration.

With reference now to FIG. 1, the apparatus 10 is shown in its folded, accessory bag configuration. An outer surface 12 of a casing 14 is generally visible in such a folded, accessory bag configuration. The casing 14 is comprised of at least one flexible sheet of material which is configured to be folded into an accessory bag, as illustrated in FIG. 1, and unfolded into a diaper changing station base, as illustrated in FIGS. 2 and 3.

Figure 3:
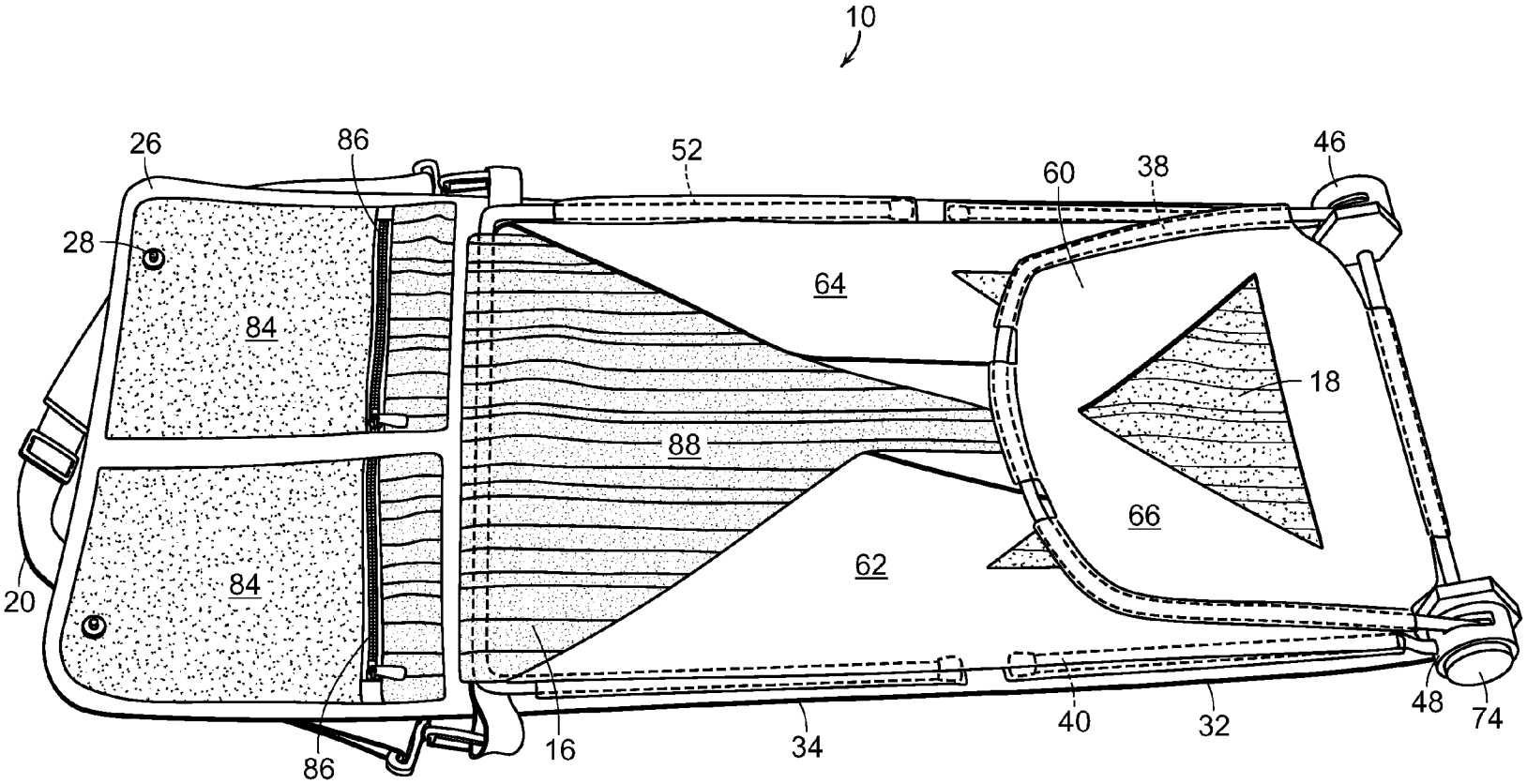
FIG. 3 is a top perspective view of the apparatus, with a first end portion of the base unfolded.

The casing 14 may be comprised of multiple flexible sheets of material, such as a sheet of material 12 which forms an outer surface of the folded accessory bag, as illustrated in FIG. 1, and which is placed on the ground or other supporting surface, as illustrated in FIG. 3. The outer surface sheet of material 12 may be comprised of any suitable material. However, it is contemplated by the invention that the outer or bottom surface 12 be comprised of a material which is sufficiently rugged so as to be placed on varying supporting surfaces, including carpet, counters, glass, or even dirt and rock. However, the material may be of a nature and design so as to be aesthetically pleasant when folded into the accessory bag configuration, as illustrated in FIG. 1, as well as being comfortable to the user carrying the apparatus 10 when folded into the accessory bag. For example, the outer surface or sheet of material 12 may comprise polyester with patterned rubber grip to prevent slippage or a canvas material, either of which would meet the objectives discussed above.

Figure 2:
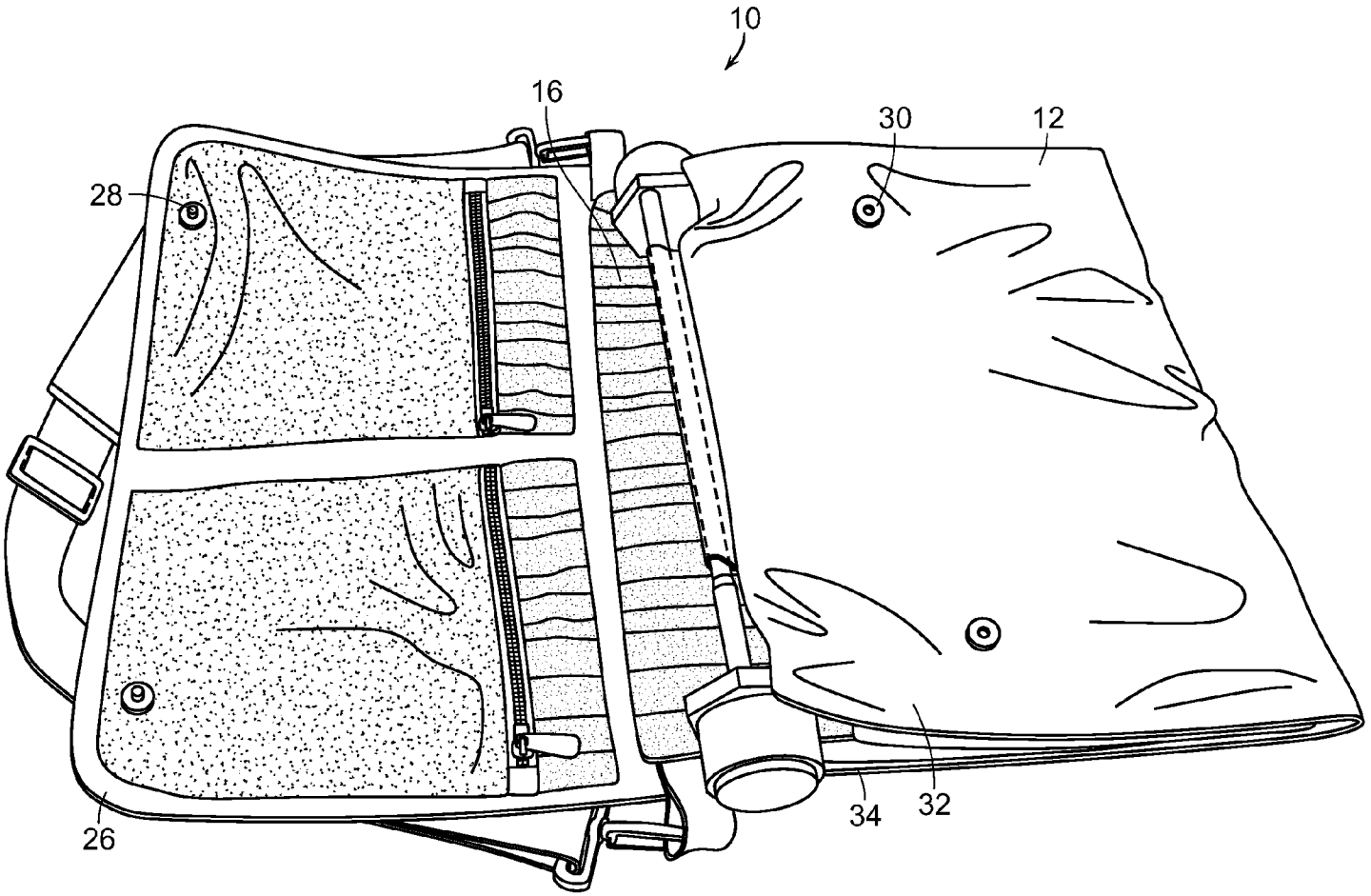
FIG. 2 is a top perspective view of the apparatus of FIG. 1, with a flap portion of a base of the changing station unfolded.

With reference now to FIGS. 2 and 3, an inner surface 16 of the casing 14 may also be comprised of any suitable material. While the material of the outer and inner surfaces 12 and 16 may be comprised of the same type of material, or even the same sheet of material, they may also be different from one another. For example, the inner or upper surface sheet of material 16 may be comprised of a patterned, quilted polyester or the like. It is contemplated by the present invention that the upper surface material 16 be of a type which is fluid-resistant or impermeable and easily cleaned. Preferably, the inner or upper surface material 16 is comprised of a material which is not uncomfortable or damaging to skin as it is possible that the infant will come into contact with the upper surface 16.

With reference again to FIG. 1, the apparatus 10 may include one or more handles 18 or carrying straps 20 for facilitating carrying and transporting the apparatus 10 in the accessory bag, folded configuration. The handle 18 and/or carrying strap 20 may be attached to the outer surface or sheet of material 12 of the casing 14, as is illustrated with the case of the handle 18 being attached directly to the outer surface 12 of the casing 14. Alternatively, or additionally, the handle 18 and/or the carrying strap 20 may be removably attached to the apparatus 10, such as by the means of clips 22 which are attachable to loops, rings, or the like 24 attached to or extending from the casing 14. The carrying strap 20 may be of sufficient length so as to comprise a shoulder carry strap, and which may be adjustable in length so as to be of a proper length for a particular user. It is also contemplated that the apparatus 10 have more than one carrying strap or a strap configuration which would enable it to be carried as a backpack. However, in a particularly preferred embodiment, as illustrated in FIG. 1, the folded apparatus 10 in the accessory bag configuration is in the form of a messenger bag or the like having a shoulder carry strap 20 attached thereto.

With reference now to FIGS. 1 and 2, in order to convert the apparatus 10 from an accessory bag configuration to a diaper changing station configuration, a flap portion 26 of the apparatus 10 is unfolded or otherwise lifted away from the folded accessory bag, as illustrated in FIG. 2. The flap may include fasteners 28 which removably attach to a corresponding fastener 30 so as to retain the flap 26 in a folded state against the casing 14 when in the accessory bag configuration, until it is desired that the flap 26 be opened, such as to remove items from the accessory bag or to unfold the apparatus 10 into a diaper changing station. The fasteners 28 and 30 may be comprised of a variety of different fasteners as is known in the art, such as friction snaps, magnetic snaps, hook and loop tape, etc. Such fasteners 28 may be formed on at least an inner surface of the flap 26 and an outer surface of a corresponding portion of the casing 14 so as to be engageable with one another when the apparatus 10 is folded into the accessory bag configuration, as illustrated in FIG. 1.

With reference now to FIGS. 2 and 3, in order to convert the apparatus into a diaper changing station, as described above, the flap portion 26 is unfolded outwardly. The casing 14 is then unfolded completely until a generally horizontal and flat base is achieved, as illustrated in FIG. 3. In the illustrated embodiment, this comprises the further step of unfolding a portion 32 of the casing or base away from the flap portion 26 so as to expose an intermediate portion 34 of the casing or base, over which the first end portion 32 and the flap portion 26 were folded over.

When the casing 14 is unfolded, it may have visual and/or physical fold lines or breaks or variations so as to facilitate unfolding and folding, such that the user may intuitively know to fold the casing or base 14 at such fold lines or areas. The apparatus 10 may include a frame assembly at least partially disposed within the casing, which is shown by the dashed lines in FIGS. 3, 5 and 7. The frame assembly gives structure and stability to the apparatus 10 and facilitates the folding and unfolding of the apparatus 10 and the raising and lowering of a canopy thereof, as will be more fully described herein.

Figure 4:
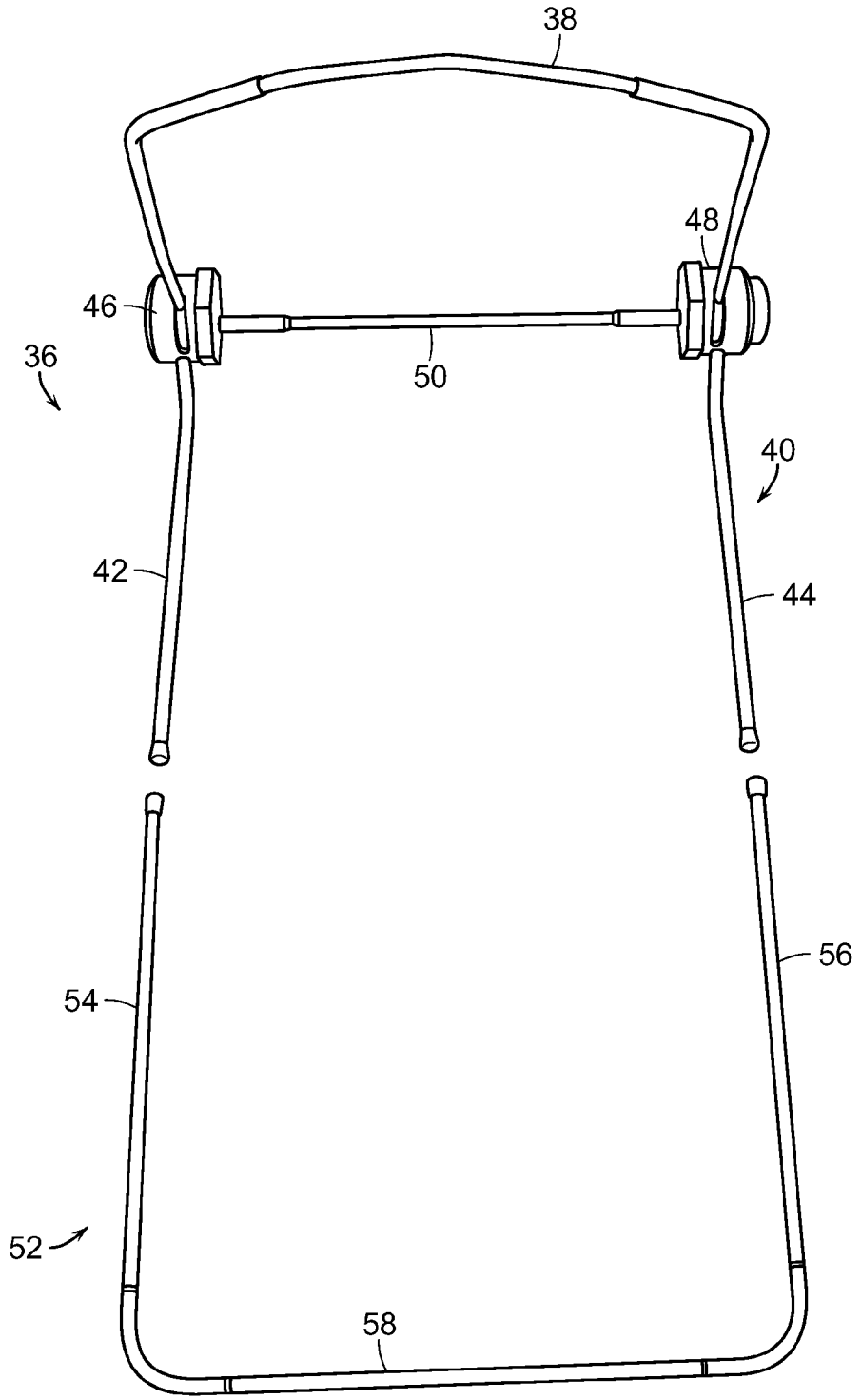
FIG. 4 is a perspective view of a frame assembly, used in accordance with the present invention.
Figure 5:
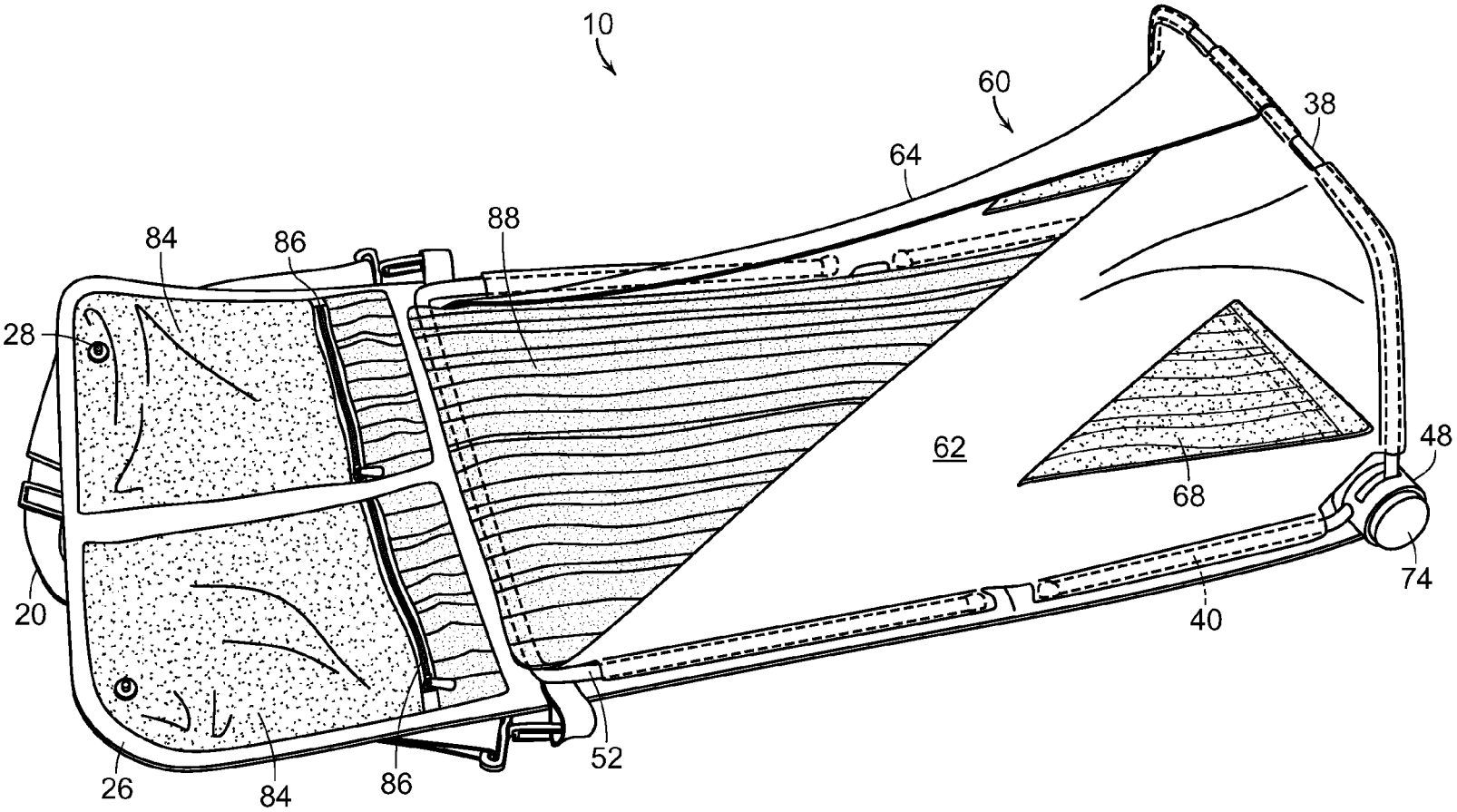
FIG. 5 is a side perspective view of a canopy of the present invention moved into an upwardly extended position, in accordance with the present invention.

An exemplary frame assembly 36 is illustrated in FIG. 4. The frame assembly 36 includes an arm 38 which is selectively moveable from an upright position, as illustrated in FIGS. 4 and 5, and a collapsed position, as illustrated in FIG. 3. A first base frame 40 is disposed within or otherwise attached to the first end portion of the base or casing 32. The arm 38 is pivotally connected or associated with the first base frame 40. The first base frame 40 comprises generally parallel rods attached to or disposed within the first portion of the base or casing 32. The rods 42 and 44 extend to hinge members 46 and 48, which are also attached to arm 38, and allow the arm 38 to be pivotally moved upwardly and downwardly. A crossbar 50 may extend between the rods 42 and 44, or the hinge members 46 and 48 attached to the rods 42 and 44.

With continuing reference to FIG. 4, in order to provide structure and stability to the apparatus 10, and facilitate folding and unfolding of the apparatus 10, a second base frame 52 is provided which is separate from the first base frame 40 and attached to or disposed within the base or casing 14, typically in the intermediate section 34 thereof. The second base frame 52 also comprises generally parallel rods 54 and 56 disposed in or otherwise attached to generally an outer edge of the base or casing 14. A cross member 58 may extend between the rods 54 and 56. The rods 54, 56 and 58 may be interconnected to one another, or formed integrally to form a unitary generally U-shaped member, as illustrated.

The frame assembly 36 is preferably comprised of one or more materials which are lightweight and provide sufficient rigidity. As such, the arm 38, the first base frame 40 and second base frame 52 may be comprised of metal, such as aluminum, fiber pole, plastic or the like. The members comprising the arm 38, first base frame 40 and second base frame 52 may be tubular or solid, and are typically only a fraction of an inch, to provide the necessary stability structure and rigidity while being lightweight. It will be appreciated that the number and configuration and size of the internal frame members and the materials that the internal frame members are comprised of may be varied as needed.

With reference now to FIGS. 3 and 5, an open-ended canopy 60 is attached to both the arm 38 of the frame assembly 36 and at least a portion of the base or casing 14. The canopy 60 is generally comprised of first and second side walls 62 and 64 and a rear wall 66 all of which have a lower edge which is connected to the base or casing 14. This may be, for example, by means of stitching, adhesive, or other suitable manufacturing processes to attach a lower edge of the canopy 60 to the base or casing 14. The canopy 60 is comprised of any suitable fabric material which enables it to be selectively collapsed and extended upwardly to form the open-ended tent structure as illustrated in FIG. 5. For example, a nylon material, such as that used in the manufacture of tents, can be used. Preferably, the material or fabric is of a type that provides a degree of privacy. The material or fabric of the canopy 60 may also provide for UV and sun and wind protection.

The canopy 60 may also be provided with one or more windows 68 formed therein to enable light to enter into the open-ended tent structure of the opened canopy 60. Such one or more windows 68 also enable the infant to view outside of the extended canopy 60. The one or more windows 68 may be comprised of a transparent or translucent material to achieve such purposes. Alternatively, the one or more windows 68 may be comprised of a mesh material, which would also facilitate air flow through the opened canopy structure 60.

With reference again to FIG. 3, after the apparatus 10 has been unfolded, as shown, the canopy 60 is raised. This may be done, for example, by grasping arm 38 or the portion of the canopy 60 attached to the arm 38 and manually lifting the arm, and thus the canopy 60 into an upright position away from the base or casing 14, as illustrated in FIG. 5. The canopy 60 is raised to a height sufficient so as to enable the infant to be placed within the open-ended tent structure of the canopy 60. This could be, for example, between one and two feet in height in the uppermost extended position.

In one embodiment of the apparatus 10, as illustrated, when the canopy arm 38 is lifted to an uppermost position, it will automatically lock into place, thus requiring unlocking in order to be lowered and collapsed. Although both hinge members 46 and 48 can comprise dual hinge and locking mechanisms, in a particularly preferred embodiment only one of the hinge members 46 or 48 comprises a locking mechanism so as to allow for single-handed operation of the apparatus 10. It is anticipated that the user will also be holding an infant while using the apparatus 10 of the present invention. This provides convenience and ease of use as the user must only lock and unlock a single hinge. The locking mechanism of hinge 46 or 48 may be a push-button or other easy latch release.

Figure 6:
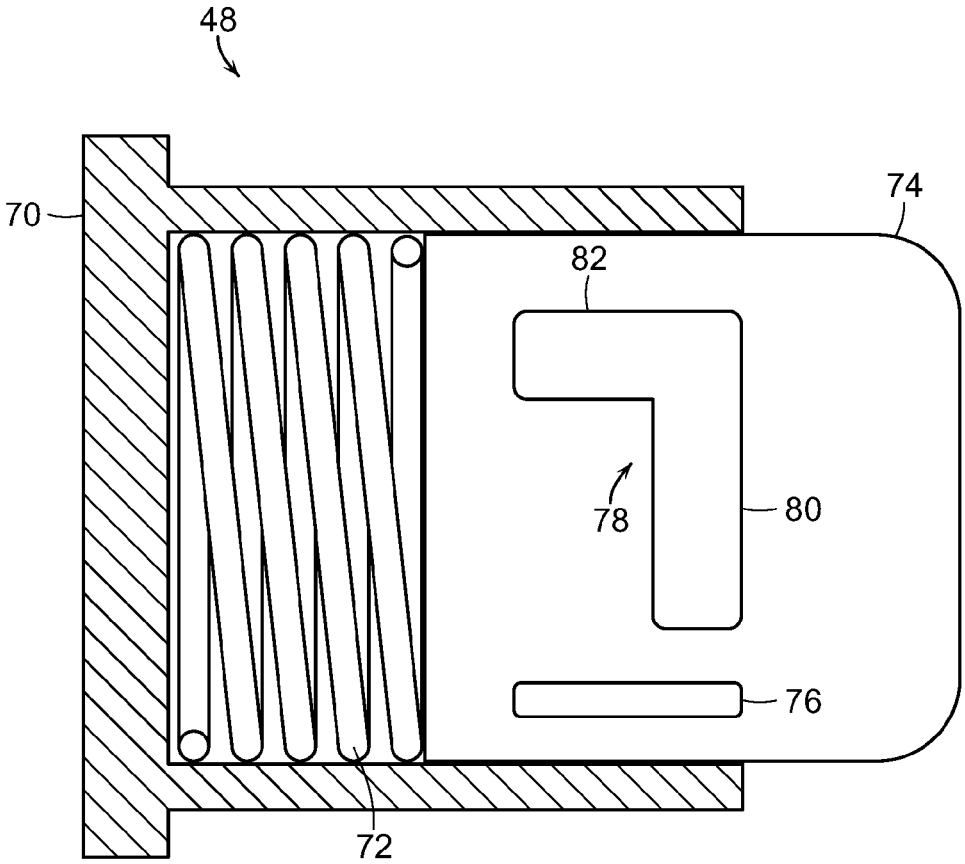
FIG. 6 is a cross-sectional and diagrammatic view of a hinge locking mechanism, used in accordance with the present invention.

With reference now to FIG. 6, hinge member 48 is illustrated, which comprises both a push-button locking mechanism and hinge assembly. The assembly 48 includes a housing 70 in which is disposed a spring 72 and from which extends a push-button actuator member 74. The push-button actuator member includes an aperture or slot 76 for receiving a portion of the first base frame assembly 40, such as rod 44, as illustrated in FIG. 4. A generally L-shaped aperture or groove 78 receives an end of the canopy arm 38 therein. This aperture 78 has a vertical slot portion 80 and a generally horizontal slot portion 82. When in the collapsed position, the arm 38 rests within the generally vertical slot portion 80 of the aperture 78. However, when the arm 38 is raised, it is allowed to slide into the horizontal slot area 82, which enables the compression of spring 72, which is illustrated as a coil spring, to push the push-button actuator member 74 outwardly and lock the arm 38 in place. In this manner, the arm 38 and canopy 60 will remain locked in an upright position until selectively unlocked and moved into the collapsed position, so as to prevent the arm 38 and canopy from inadvertently collapsing and falling upon the infant while the infant is within the open-ended tent structure of the expanded canopy 60. In order to unlock the mechanism, the push-button actuator member 74 is pushed inwardly until the arm 38 is moved into slot 80 of aperture 78.

While an exemplary hinge and locking mechanism assembly 48 has been described and illustrated, it will be appreciated that other hinge and locking mechanisms could be used to accomplish the needs of the invention. For example, it is contemplated by the present invention that the locking and non-locking hinges 48 and 46 be substituted with spring-loaded elbow joints, allowing for a hands-free lift. In this case, as the apparatus 10 is unfolded, as illustrated in FIG. 3, the canopy arm 38 would automatically raise. When collapsing, the user would merely need to apply downward pressure on the canopy arm 38 to push it towards the base or casing 14, and then fold the casing, in the reverse manner as discussed above, into the accessory bag configuration, as illustrated in FIG. 1.

One or more pockets 84 are formed in the apparatus 10 which can be used to store diaper changing accessories, such as wet wipes, diapers, ointment and the like. Such pockets 84 could be formed in or onto the canopy structure 60 or the casing or base 14. In a particularly preferred embodiment, pockets 84 are formed on an inner surface of the flap portion 26 of the casing or base. These pockets 84 are of a sufficient size so as to hold the necessary items to change the infant's diaper, such as a diaper, wet wipes, and the like. Although two pockets 84 are illustrated formed on the inner surface of flap portion 26, it will be understood that only a single pocket 84 may be formed, or more than two pockets formed on the flap portion 26, or even other areas of the apparatus 10. Preferably, the one or more pockets 84 include a closure 86, such as the illustrated zipper.

Figure 7:
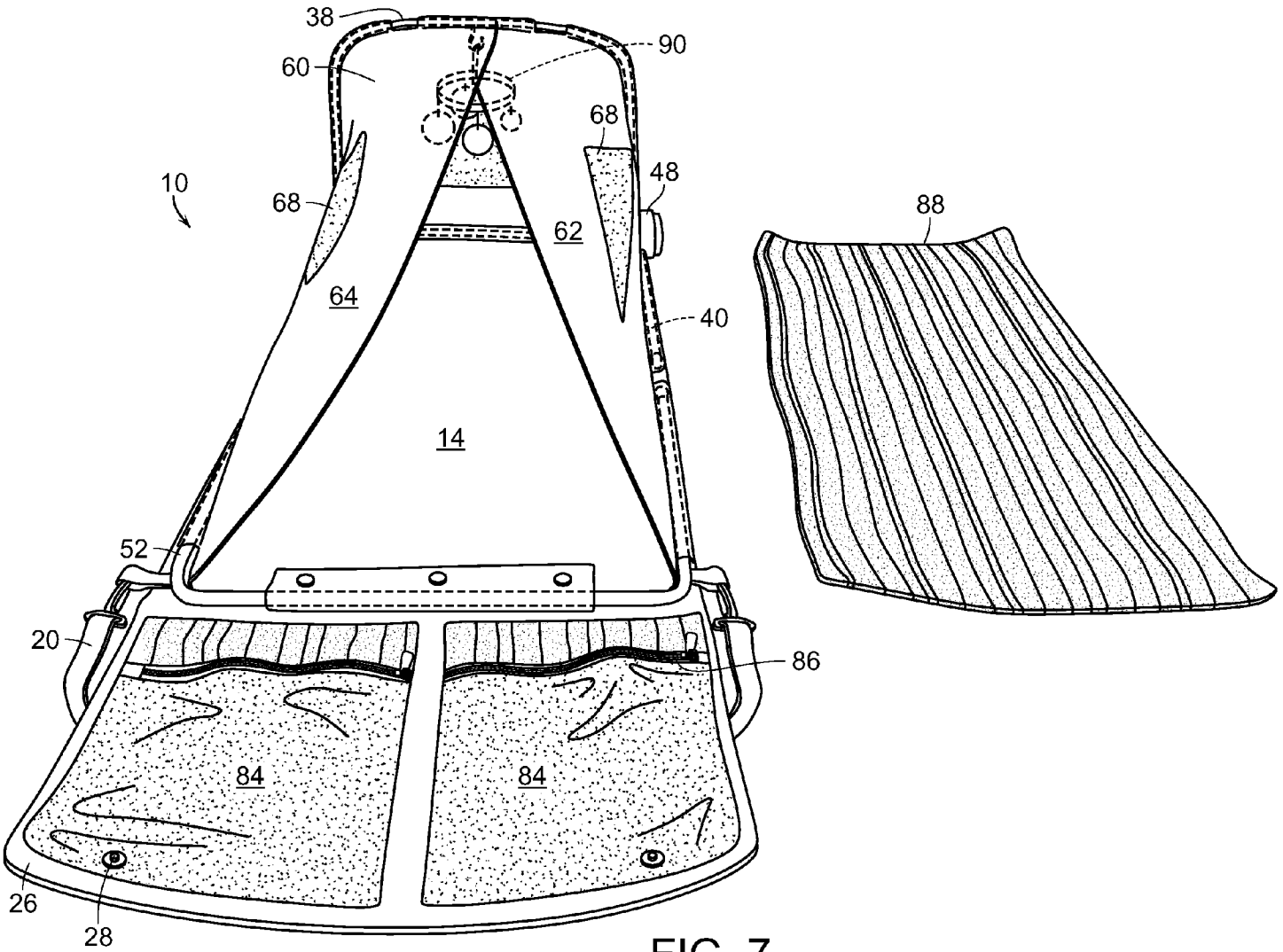
FIG. 7 is an end perspective view of the unfolded diaper changing station, with a diaper changing pad removed from under the canopy.

While the one or more pockets 84 may be formed in or on any portion of the apparatus 10, it has been found to be particularly advantageous to form or attach the pockets 84 to the inner surface of the flap portion 26. This provides the convenience of accessing the items within the one or more pockets 84 when the apparatus 10 is folded into the accessory bag, as illustrated in FIG. 1, by merely unfastening and lifting flap 26 to gain access to the one or more pockets 84 and the contents therein. Moreover, when the apparatus is unfolded and arranged into the diaper changing station configuration, as illustrated in FIGS. 5 and 7, the one or more pockets 84 are close to the parent or caregiver who is changing the infant's diaper, and thus the supplies are readily available in a convenient location. Furthermore, the contents of the pockets 84 are disposed away from the first end of the base or casing where the infant's head and hands and arms are, reducing the possibility that the infant would undesirably grab items from the pockets 84.

The casing or base 14 may be sufficiently padded, at least under the portion of the canopy 60 where the infant is to be placed, so as to provide cushion and comfort to the infant while lying thereon. Alternatively, or in addition to, a changing pad 88 is formed in the intermediate 34 and first end 32 portions of the apparatus 10 where the infant is to be placed. The changing pad 88 may be advantageously removable from under the canopy 60, as illustrated in FIG. 7, such that the changing pad 88 may be more easily cleaned. Preferably, at least one surface of the changing pad 88 is comprised of a material which can be easily cleaned and which is water resistant or impermeable. The changing pad 88 may also be comprised of a sheet of material which is sufficiently thick so as to be cushioned or have a foam cushion disposed within one or more sheets of material to form the changing pad.

With reference now to FIG. 7, it is contemplated by the present invention that a decorative element or distraction device 90, such as a musical mobile or toy, be attachable or otherwise extend downwardly within the canopy 60, such as downwardly from the canopy arm 38. The mobile or distraction element 90 would provide the infant something of interest and distract the infant and garner its attention while the parent is changing the infant's diaper. Alternatively, if the infant is placed within the tent-like structure of the canopy 60 in order to rest, sleep, etc. such device 90 could be useful in entertaining the infant or helping the infant to fall asleep. Such a distraction device 90 may be permanently affixed to the canopy 60 or canopy arm 38, or may be selectively attached thereto such as after the canopy 60 is lifted. Such may be done, for example, by means of a clip and loop arrangement or other releasable connection means.

It will be appreciated that the apparatus 10 of the present invention can be of varying sizes as determined to meet the needs of the user. However, the apparatus 10 is of such a size so that when fully collapsed and in a closed state of the accessory bag, as illustrated in FIG. 1, the apparatus 10 is of a sufficiently small size so as to be carried easily. However, the apparatus 10 must be of a sufficiently large size so as to function as a diaper changing station and support an infant within the raised canopy 60. By way of example, the apparatus 10 may be approximately eighteen inches in width and approximately thirty inches to forty-five inches in length when fully unfolded. As can be seen in FIGS. 3, 5 and 7, the side walls 62 and 64 of the canopy 60 extend substantially the length of the first end 32 and intermediate 34 sections, and the rear wall 66 of the canopy 60 extends substantially the width of the casing or base of the apparatus 10. This creates a canopy of sufficient size so as to substantially, if not entirely, encompass the infant therein, while providing sufficient access to the infant through the open-ended tent structure which the canopy 60 forms, as illustrated in FIGS. 5 and 7, when the canopy is erected.

In order to reconfigure the apparatus 10 from the diaper changing station, as illustrated in FIG. 5, to the accessory bag configuration as illustrated in FIG. 1, the canopy arm 38 is lowered towards the base or casing 14. This may require the unlocking of locking mechanism 48, such as by pushing push-button actuator member 74 and physically lowering the arm 38, causing the canopy 60 to fold and collapse upon the base. The first end portion of the base or casing 32 is then folded upon the intermediate segment 34, as illustrated in FIG. 2. The flap portion 26 is then folded over the first end portion and stacked intermediate portion 34, as illustrated in FIG. 1. The flap portion 26 may be releasably fastened in place, as described above. The apparatus 10 can then be easily carried by means of the handle 18, shoulder carry strap 20, or other strap arrangement.

Although several embodiments have been described in detail for purposes of illustration, various modifications may be made without departing from the scope and spirit of the invention. Accordingly, the invention is not to be limited, except as by the appended claims.

What is claimed is:

1. A combination accessory bag and diaper changing station, comprising:

a casing comprising at least one flexible sheet of material, the casing being configured to be folded into an accessory bag and unfolded into a diaper changing station base;

an open-ended canopy having first and second side walls and a rear wall attached to a first end of the base;

a frame assembly at least partially disposed within the casing and including an arm pivotally attached to a first frame base and attached to the canopy, wherein the canopy and the arm are selectively movable between a collapsed position adjacent the base and an extended position away from the base to form an open-ended tent structure at a first end of the base;

a locking mechanism associated with the arm for selectively locking the arm and canopy in place;

a padded diaper changing pad disposed under the canopy;

a pocket formed in or attached to a second end of the base defining a flap portion; and fasteners attached to the flap portion and a corresponding portion of the casing for selectively fastening the flap portion to the casing when the casing is folded into the accessory bag.

* * * * *